United States Patent [19]

Hara

[11] 4,392,337

[45] Jul. 12, 1983

[54] APPARATUS FOR ATTACHMENT OF CARRIER SHEET TO CONTAINERS

[75] Inventor: Kunio Hara, Kawasaki, Japan

[73] Assignee: Nifco, Inc., Tokyo, Japan

[21] Appl. No.: 104,926

[22] Filed: Dec. 18, 1979

[30] Foreign Application Priority Data

Dec. 18, 1978 [JP] Japan ..... 53-154881

[51] Int. Cl.[3] ..... B65B 27/04

[52] U.S. Cl. ..... 53/48; 53/556; 53/585

[58] Field of Search ..... 53/398, 399, 441, 48, 53/291, 292, 296, 297, 556, 585; 156/86

[56] References Cited

U.S. PATENT DOCUMENTS

| | | | |
|---|---|---|---|
| 2,103,302 | 12/1937 | Strout | 53/291 X |
| 2,340,211 | 1/1944 | Balsley | 53/291 |
| 2,732,115 | 1/1956 | Allen | 53/441 X |
| 2,843,986 | 7/1958 | Carter | 53/291 |
| 2,929,181 | 3/1960 | Poupitch | 53/398 |
| 3,404,505 | 10/1968 | Hohl | 53/398 |
| 3,551,258 | 12/1970 | Galvanoni | 53/291 X |
| 3,628,305 | 12/1971 | Owen | 53/398 |
| 4,016,704 | 4/1977 | Fujio | 53/292 X |
| 4,144,631 | 3/1979 | Fujio | 53/585 |
| 4,177,546 | 12/1979 | Geisinger | 53/585 |
| 4,208,857 | 6/1980 | Fujio | 53/585 |

*Primary Examiner*—John Sipos

*Attorney, Agent, or Firm*—Thomas W. Buckman

[57] ABSTRACT

A plastic carrier sheet is attached to containers by passing the sheet, via openings therein, onto funnel members whose large-diameter portions are engaged with the peripheral edge of the containers, passing onto the funnel members, from the small-diameter portions to the large-diameter portions thereof, sleeve members each containing an opening having an edge diameter smaller than the largest diameter of the funnel members and having an edge which is expandable, whereby the sleeve members push the edges of the openings of the carrier sheet toward the large-diameter portions of the funnel members to expand the openings and enable the circumferential portions to ride over and past the peripheral edges of the corresponding containers.

2 Claims, 16 Drawing Figures

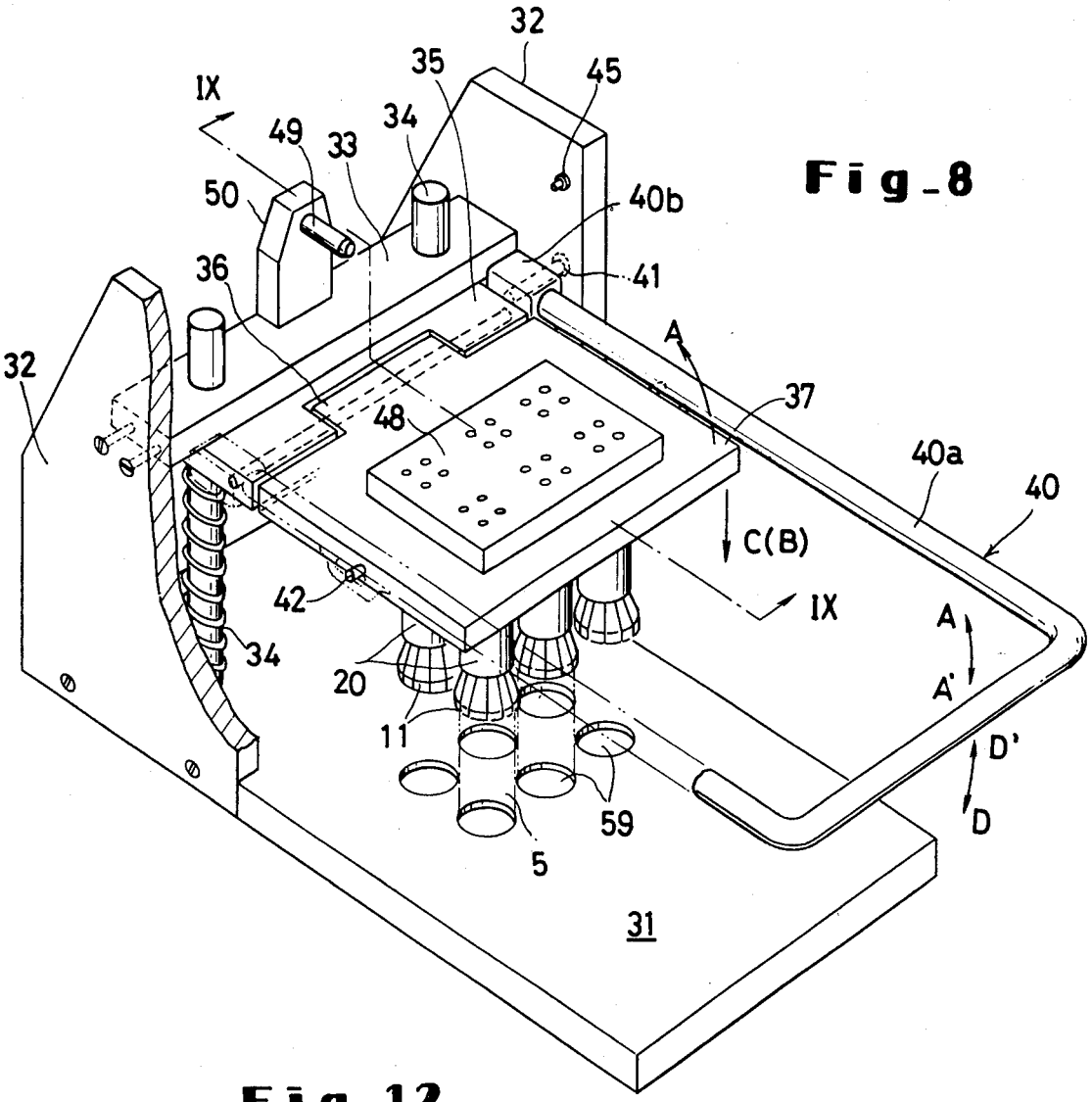
Fig_8
Fig_12
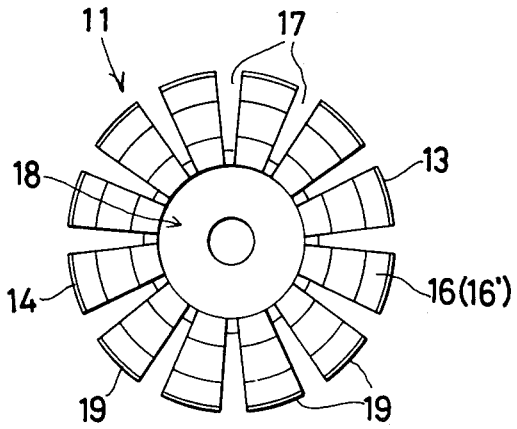

APPARATUS FOR ATTACHMENT OF CARRIER SHEET TO CONTAINERS

BACKGROUND OF THE INVENTION

This invention relates to a method and apparatus for the attachment of a plastic container carrier sheet to the peripheral edges of a plurality of containers such as for soft drinks, which carrier sheet is adapted to have the plurality of containers bound into one set for convenience in carrying.

Among the carrier implements adapted to bind collectively the peripheral edges of a plurality of containers standing side by side on their flat ends for the purpose of ensuring convenience in carrying such containers, there is included a plastic container carrier sheet.

The sheet has a plurality of openings each surrounded by a circumferential portion. In the remaining intervening spaces of the sheet, there are provided a few (say, two) grip holes adapted for insertion of the fingers.

In an ordinary container such as a can for a soft drink, both or at least one of the opposite ends of the container has its end surface slightly bent inwardly except for the peripheral edge which circumferentially surrounds the end. The circumferential edge has a diameter slightly greater than the diameter of the main portion of the container which lies underneath. In most cases, these containers are made of aluminum.

The openings in the carrier sheet have a diameter smaller than the diameter of the main portion of the container. This sheet, therefore, is attached to the containers by forcibly expanding the circumferential portions of the openings to enlarge the openings and allow the peripheral edges to slide past the circumferential portions, then allowing the circumferential portions to resume their original shape thereby causing the inner surfaces of the circumferential portions to come into tight contact with the outer surfaces of the main portions of the containers. After the sheet has been attached as described above, the user has only to insert his thumb and index finger into the grip holes and get hold of the remaining portion of the sheet. In this manner, he can carry the containers conveniently without requiring a holder as would otherwise be required in carrying the plurality of containers.

As described above, the carrier sheet of such a construction proves to be highly useful. One problem which has been encountered by the conventional carrier sheet concerns the procedure involved when the openings are forcibly expanded out in effecting the attachment of the sheet to the containers. This forcible outward expansion of the openings, when made with the finger tips on all the containers, requires a considerable amount of force, though it is not impossible. From the standpoint of operational efficiency and in consideration of the large number of openings involved, such a manual procedure proves substantially impracticable.

To cope with the situation, therefore, there has been suggested a device capable of mechanically effecting this work (U.S. Pat. No. 3,628,305). This device is adapted so that two pins are inserted inside a pair of opposed openings and the pair of openings are expanded outwardly. This device, consequently, has the disadvantage that the circumferential portions tend to be torn, expanded unevenly, and brought into contact with the outer surfaces of the containers with insufficient tightness. Besides, this device entails a serious problem that when the pins are removed after the ends of the containers have been inserted into the expanded openings, the pins, which must be of gret rigidity, tend to scratch the containers, possibly to the extent of impairing their commercial value.

The object of the present invention is to provide a method and apparatus for easily and effectively attaching a carrier sheet to containers without entailing any damage to the carrier sheet or the containers.

SUMMARY OF THE INVENTION

The object of the present invention as described above can be attained by passing a carrier sheet, via the openings thereof, onto funnel members each having a portion of a diameter smaller than the diameter of the openings in the carrier sheet and a funnel-shaped portion having an intermediate portion of a diameter substantially equal to the diameter of the openings and a large-diameter leading-edge portion adapted for engagement with the peripheral edge of the container, until the carrier sheet reaches the portions of the funnel members having a diameter substantially equal to the diameter of the openings, and bringing the leading ends of the funnel members into engagement with the peripheral edges of the containers; passing sleeve members each containing an opening having an edge diameter smaller than the largest diameter of the large-diameter portion of the funnel member onto the funnel members from the smaller diameter end thereof, advancing the sleeve members onto the funnel members toward the large-diameter leading end thereof while allowing the edge thereof to be expanded in the radial directions, whereby the sleeve members push the edges of the openings of the carrier sheet toward the large-diameter leading end of the funnel members to expand the openings and enable the circumferential portions to ride over and past the peripheral edges of the corresponding containers.

Thus, due to the uniform expansion of the openings in the carrier sheet, the attachment of the carrier sheet to the containers causes no damage to the carrier sheet and can easily be effected.

The other objects and characteristics of the present invention will become apparent from the description to be given hereinafter in detail with reference to the accompanying drawing.

BRIEF EXPLANATION OF THE DRAWING

FIG. 8 is a partially cutaway perspective view of the second embodiment of this invention.

FIG. 12 is a plan view of the funnel member to be used in the second embodiment.

DETAILED DESCRIPTION OF PREFERRED EMBODIMENTS

Figure 1:
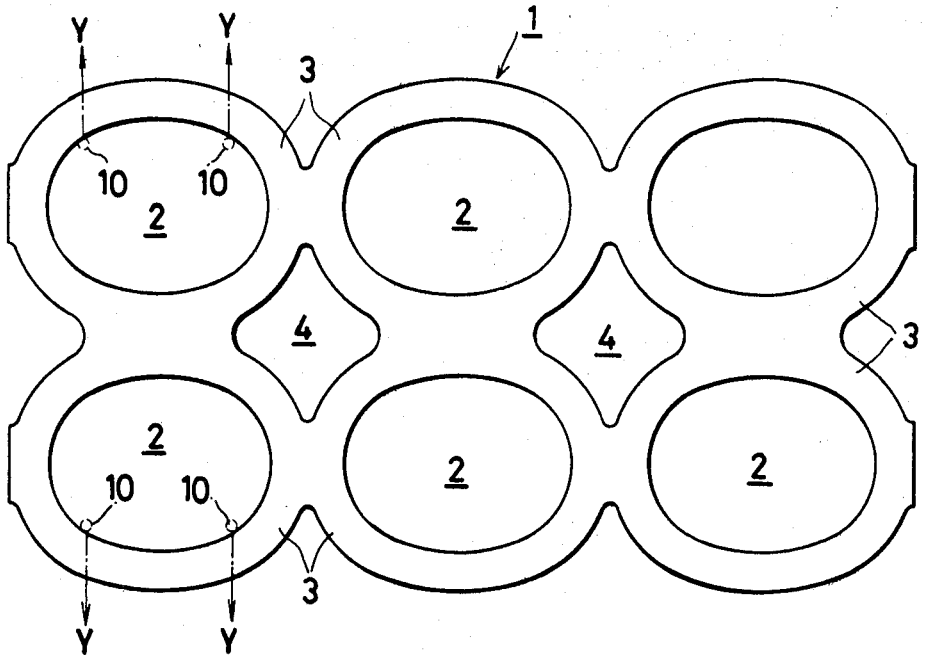
FIG. 1 is a plan view of a carrier sheet to be attached to a given set of containers by the apparatus of this invention.
Figure 2:
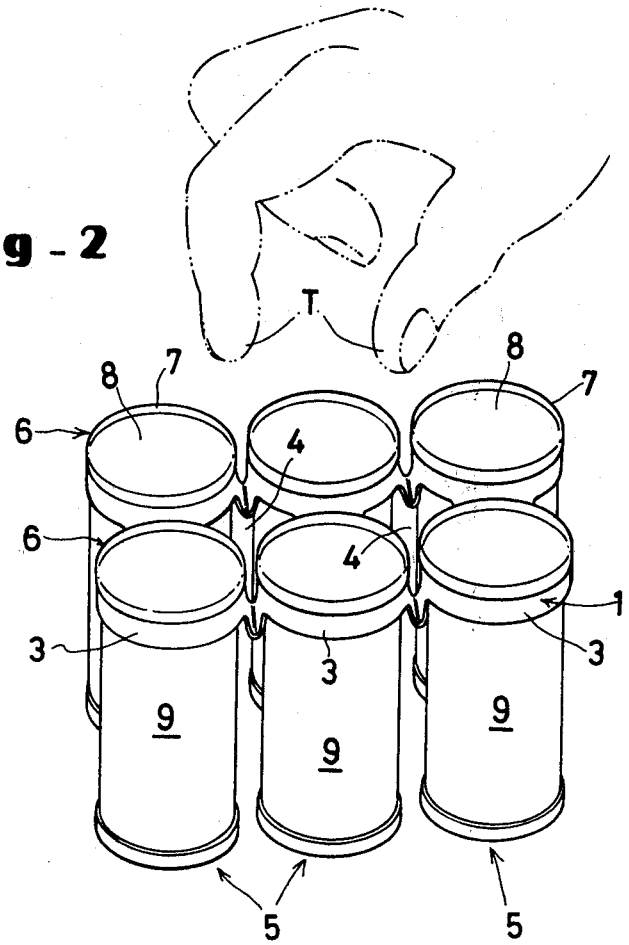
FIG. 2 is an explanatory diagram illustrating the state wherein a given set of containers are held by the carrier sheet.
Figure 3:
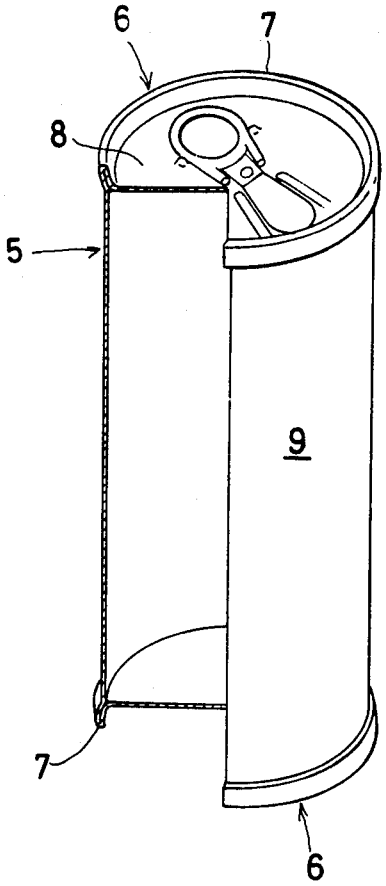
FIG. 3 is a partially cutaway perspective view of a container to which the sheet is attached.

FIG. 1 shows a plastic carrier sheet for containers and FIG. 2 a given set of containers held by the carrier sheet. In an ordinary container such as a can for a soft drink, as shown in FIG. 3, both or at least one of the opposite ends 6 has its end surface 8 bent slightly inwardly except for a peripheral edge 7 which circumferentially surrounds the end. The circumferential edge 7 has a diameter slightly greater than the diameter of the main portion 9 of the container which lies underneath. In most cases, these containers are made of aluminum.

Openings 2 in the sheet 1 have a diameter smaller than that of the main portion 9 of the containers and, naturally, smaller than the diameter of the peripheral edge 7 which is greater than the diameter of the main portion. This sheet 1, therefore, is attached to the containers 5 as illustrated in FIG. 2 by forcibly expanding the circumferential portions 7 of the openings to enlarge the openings 2 and allow the peripheral edges 7 to slide past the circumferential portions, then allowing the circumferential portions to resume their original shape thereby causing the inner surfaces 3*a* of the circumferential portions 3 to come into tight contact with the outer surfaces of the main portions 9 of the containers. After the sheet 1 has been attached as described above, the user has only to insert his thumb and index finger T into the grip holes 4 and get hold of the remaining portion of the sheet. In this manner, he can carry the containers conveniently without requiring a holder as would otherwise be required in carrying the plurality of containers.

As described above, the carrier sheet of such a construction proves to be highly useful. One problem which has been encountered by the conventional carrier sheet concerns the procedure involved when the openings 2 are forcibly expanded out in effecting the attachment of the sheet to the containers. This forcible outward expansion of the openings, when made with finger tips on all the containers, requires a considerable amount of force, though it is not impossible. From the standpoint of operational efficiency and in consideration of the large number of openings involved, such a manual procedure proves substantially impracticable.

To cope with the situation, therefore, there has been suggested a device capable of mechanically effecting this work. This device is adapted so that pins 10 are inserted inside the openings 2 as indicated by chain lines in only two of the openings 2 of FIG. 1 and the pair of openings 2 are expanded outwardly by moving the pins 10 outwardly as indicated by the arrows Y. As readily noted from the arrangement just described, each pin 10 exerts its expanding force at only one point in the circumferential portion 3. This device, consequently, has the disadvantage that the circumferential portions tend to be torn, expanded unevenly, and brought into contact with the outer surfaces of the containers with insufficient tightness. Besides, this device entails a serious problem that when the pins are removed after the ends of the containers have been inserted into the expanded openings, the pins, which must be of great rigidity, tend to scratch the containers, possibly to the extent of impairing their commercial value. Generally the pins 10 are adapted so as to be driven straight outwardly in a common parallel plane. When about six containers are simultaneously packaged as illustrated, therefore, the device incorporating these pins inevitably occupies a fairly large space and tends to be impaired in the flexibility of its operation in field work.

Moreover, as concerns the shape of the openings 2 for insertion of the containers, the mere fact that the openings 2 have a diameter smaller than the diameter of the peripheral edges 7 of the containers or preferably even smaller than the diameter of the main portions 9 of the containers, does not necessarily mean that the openings fulfill their function satisfactorily. In view of the directions in which the pins 10 are allowed to operate, the shape of the openings has unfortunately been limited to that of an ellipse having as its minor axis the distance covered by the movement of the pins. Since the circumferential portions 3 of the openings are made of a plastic material possessed of both deformability and adaptability of shape, the openings by nature should not be limited in shape. Further from the standpoint of the simplicity of the tool used for making such openings in the carrier sheet, the openings are naturally desired to be shaped as circles. Also from this point of view, the device falls short of satisfactoriness.

In view of the state of affairs mentioned above, the present invention aims to provide a method for the attachment of a carrier sheet and an apparatus for carrying out the method which has the most convenient and compact construction and is free from the disadvantages suffered by the conventional apparatus as described above.

The description of the present invention will be started with an embodiment which has a relatively small number of component elements. For the sake of convenience, the operation of the invention will be described by portraying the manner in which a sheet 1 possessing a plurality of openings 2 for insertion of as many containers 5 is attached to the containers one by one.

Figure 4:
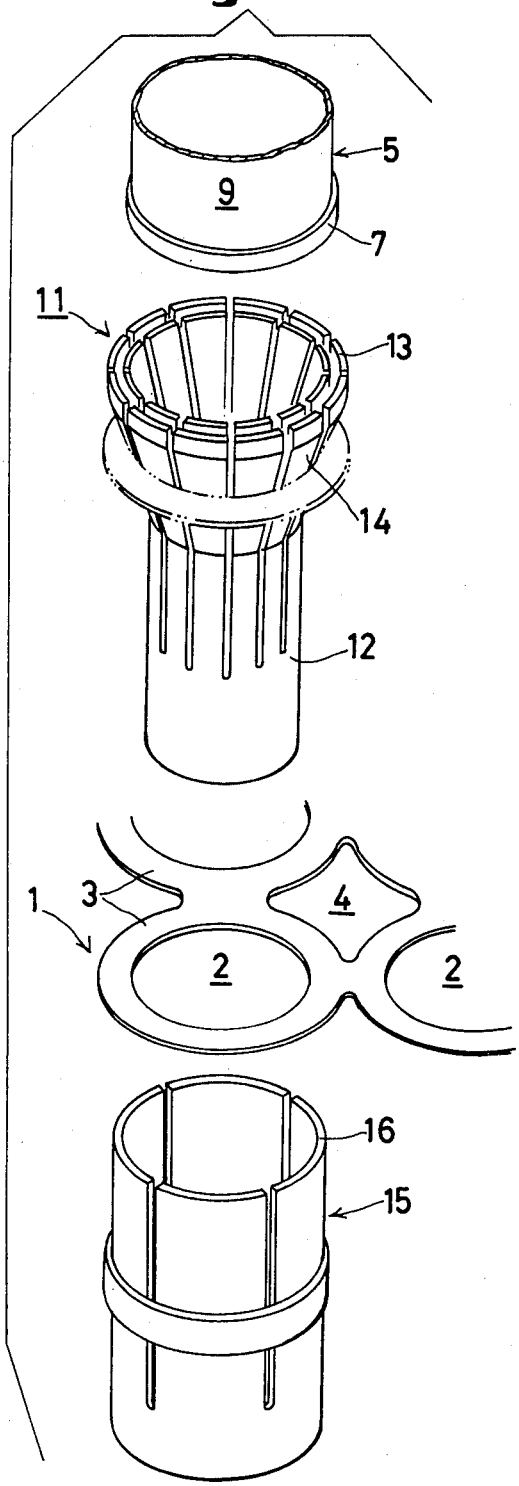
FIG. 4 is an exploded perspective view of the first embodiment of the present invention.

FIG. 4 is an exploded perspective view of the first embodiment of this invention. The first member of this embodiment is a funnel member 11 which has a funnel-shaped opening at the leading end thereof. The funnel member 11 in this embodiment has a substantially cylindrical shape up to a point near the middle of its entire length and, from the end of the cylindrical portion 12 or the portion of a relatively small diameter, begins to grow gradually in diameter toward the leading end 13 to form a diverging funnel portion 14. In this case, the outside diameter of the funnel member 11 is smaller than the initial diameter of the opening 2 (the diameter before the corresponding circumferential portion 3 are deformed) in the sheet 1 not merely in its small-diameter portion 12 but also to a point halfway along the length of the diverging funnel portion 14. As the funnel member 11 is inserted in the direction of the base end 15 into the sheet 1 through the opening 2, the sheet 1 can be moved without exertion of force until it is fitted to the outer surface of the diverging funnel portion 14 halfway along the entire length thereof (as indicated by the chain line in FIG. 1).

In the leading end 13, the funnel member 11 is provided with a contact member 16 adapted for contact with the peripheral edge 7 of the container 5 to which the sheet 1 is to be attached. This contact portion 16 possesses a wall surface 19 destined to fall on the outer surface of the peripheral edge 7. In the present embodiment, the wall surface 19 forms a stepped portion 16' for the purpose of snugly embracing the peripheral edge 7 and ensuring the stability of the function described below.

In the present embodiment, the funnel member 11 may have its interior 18 filled or left empty. However, to heighten the ability of the funnel to restore to its original shape after the attachment of the sheet to the container is completed as described afterward, the funnel member preferably has a hollow construction. It is further desired to contain a plurality of spaced slits 17 cut in the longitudinal direction to halfway the entire length thereof, as illustrated, to divide the diverging funnel portion 14 completely and the smaller diameter portion 12 partly in the circumferential direction each into a plurality of portions and impart required flexibility and resilience to the funnel member.

For the funnel member 11 of the aforementioned construction, a sleeve member 20 is separately provided. The sleeve member 20 has the shape of a column (cylindrical in the illustrated embodiment) which has its interior 21 left empty and opens at at least one end. The inside diameter of the interior space 21 is substantially equal to or slightly smaller than the inside diameter of the opening 2 formed in the sheet 1 for insertion of the container, so that the edge 22 of the opening collides with the surface of the circumferential portion 3 surrounding the opening 2 for the insertion of the container when the opening 3 formed in the sheet for the insertion of the container is fitted to the opening. The depth of the interior space 21 is at least equal to or greater than the entire length of the funnel member 11.

The wall surface portion 23 of the sleeve member which defines the interior space 21 is divided in the circumferential direction by the slits 24 cut in the longitudinal direction from the edge 22 downwardly so as to acquire positive outward expansibility and ample resilience as is required for the function to be described afterward. The construction described above suffices as it is where desired expansibility and resilience are attained by adopting a plastic material, imparting resilience to the wall surface portion 23 itself or giving an ample wall thickness to the wall surface portion. Where more powerful resilience is desired, a resilient ring 25 such as a rubber band may be wound around a portion of the peripheral surface of the wall surface portion 23 so as to improve the resilience. For the purpose of preventing the resilient ring 25 from moving out of position in the axial direction, a snap-ring means 26 (FIG. 5) or other similar means may be disposed on the outer surface of the wall surface portion 23.

The funnel member 11, by nature, may be formed of any desired material. With a view to imparting resilience thereto and for the sake of ease of molding, it is desired to be made of a suitable plastic material.

Figure 5:
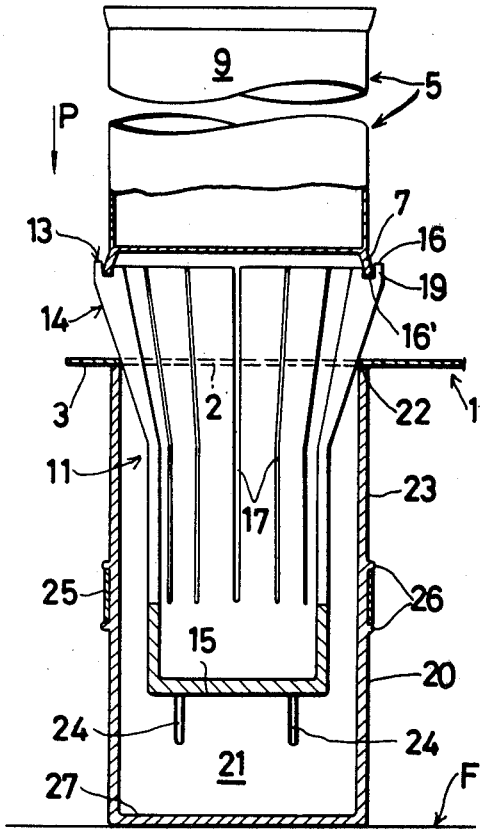
FIG. 5–7 are sectioned views each for the explanation of the operation of the first embodiment of the present invention.
Figure 6:
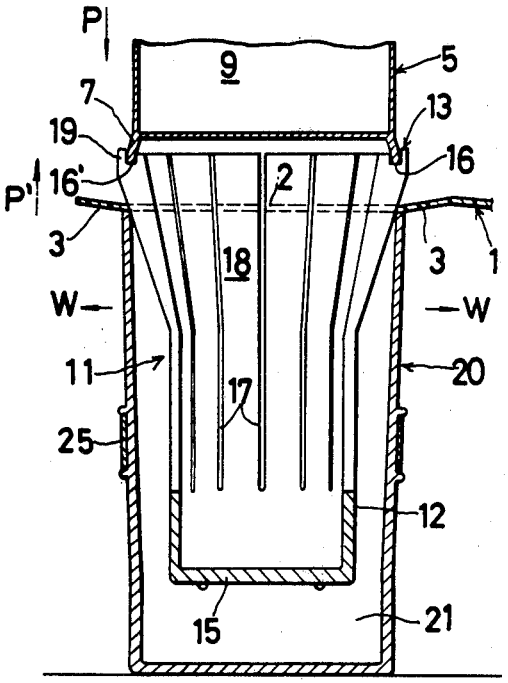
Figure 7:
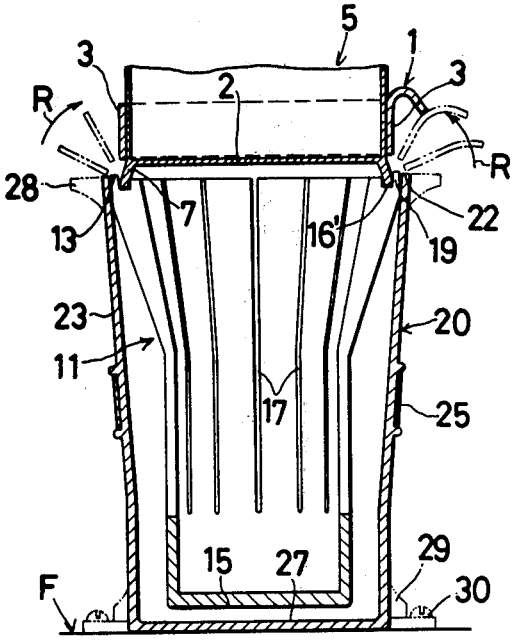

With the apparatus formed of the aforementioned components, the procedure by which the attachment of the sheet 1 to the container 5 is accomplished involves the steps illustrated sequentially in FIGS. 5–7.

In the first step illustrated in FIG. 5, the sheet 1 surrounding the opening 2 for the insertion of the container is inserted around the funnel member 11, with the base end 15 thereof in the lead as touched upon briefly before. It is moved up the funnel member 11 and set firmly in position after it has advanced to a position halfway the entire length of the diverging funnel portion 14 where the outside diameter of the funnel portion 14 is substantially equal to the inside diameter of the circumferential portion 3 and, therefore, the funnel portion 14 does not deform the circumferential portion 3. Then, the funnel member 11 is inserted in the direction of the base end 15 into the interior space 21 of the sleeve member 20. Because of the aforementioned correlation of diameters, this insertion can be continued until the edge 22 of the opening in the sleeve member collides with the peripheral surface of the diverging funnel portion 14 near the position at which the sheet 1 is fitted without exertion of force to the funnel portion.

After the insertion is completed, the container 5 to which the sheet is to be attached is positioned so that the peripheral edge 7 used for the purpose of the attachment is snugly mounted on the aforementioned contact portion 16 or 16' (stepped portion) surrounded by the wall surface 19 at the end of the funnel member 11.

With the container mounted on the funnel member, the bottom 27 of the sleeve member 20 is stably set on a suitable support surface F.

Then, a force is exerted for the sleeve member 20 and the container 5 to be moved in mutually approaching directions. In the present case, a depressive force (indicated by the arrow P) is applied to the opposite end side of the container 5 toward the sleeve member 20 by the hand or some other means while the sleeve member 20 is kept on the support surface F.

As a result, the funnel member 11 forces its way into the sleeve member 20 while the gradually expanded portion of the diverging funnel portion 14 pushes the wall of the sleeve member 20 outwardly. In this case, because of the presence of the wall surface 19 which comes into contact with the outer surface of the peripheral edge of the container, the funnel member 11 is not bent inwardly even when it has a hollow interior 18. Conversely, the wall surface 23 of the sleeve member 20 is diverged as indicated by the arrow W in proportion to the increasing divergence of the outer surface of the diverging funnel portion 14 which is forcing its way into the sleeve member. Thus, the edge of the opening 22 appears to be advancing in the direction of the leading end 13 of the funnel member (as indicated by the chain line P').

While the aforementioned motion of the components is continuing, because the diverging funnel portion 14 of the funnel member 11 forces its way toward the point at which the sheet 1 is held up fast in position by the edge of the opening of the sleeve member, the sheet 1 is caused to advance in the direction of the arrow P' toward the leading end 13 of the diverging funnel portion where the outside diameter reaches its maximum (the wall surface 19 engaging the peripheral edge 7 of the container from outside).

When this motion is further continued and the funnel member 11 is completely received as far as the leading end 13 into the sleeve member 20, the sheet 1 is pushed up from behind by the edge 22 of the opening of the sleevemember and the circumferential portion 3 or the opening 2 is expanded to a diameter greater than the peripheral edge 7 of the container. Thereafter, the sheet 1 is pushed out of the leading end 13 of the funnel member.

As a result, the sheet 1 which has been relieved of the outwardly expanding force slides to the base of the peripheral edge 7 of the container as it tends to cause the radially extended circumferential portion 3 to contract by its own resilience in the direction of resuming its original state. Since the inner edges of the opening 2 is held down with equal force by the peripheral edge, the outer edge of the circumferential portion 3 generates a more positive resilient function. As viewed in cross section, the sheet 1 rotates or twists as indicated by the arrow R with the edge on the opening 2 side as the fulcrum, with the result that the surface of the circumferential portion 3, which has heretofore been flat, squeezes itself into an annular shape underneath the peripheral edge of the container. Thus, the attachment of the sheet 1 to the container 5 is completed.

At this time, the circumferential portion 3 of the sheet must be prevented from being twisted in the reverse direction and wound around the side of the edge 22 of the opening in the sleeve. Perfect prevention of this trouble is obtained by causing an extended portion 28 protruding in the radial direction to be disposed along the whole, or at least part, of the edge 22 of the opening.

Where this extended portion is incorporated, stable retention of the sheet under pressure can be obtained even during the intermediate step illustrated in FIG. 6.

There is a possibility that, depending on the extent to which the sheet is outwardly expanded, the outer edge of the circumferential portion 3 of the sheet will roll up and cling to the diverging funnel portion 14 before it reaches the peripheral edge 7 of the container. If this happens, safe fitting may be obtained by causing the neighborhood of the inner edge of the opening 2 to be continuously pushed up with the edge 22 of the opening in the sleeve, then allowing the inner edge to ride over the edge 17 and also allowing the outer surface of the peripehral edge of the container to slide continuously in the axial direction. In any event, the sheet is allowed to cling by its own resilient force to the base of the peripheral edge of the container when the sheet 1 is continuously expanded outwardly and, at the same time, pushed up as far as the leading end 13 of the diverging funnel portion 14, then slid over the leading end 13 and finally relieved of the expanding force.

Further, as is plain from the aforementioned description made of the sequential steps of the operation involved, the attachment can be alternatively obtained by pressing the sleeve member 20 down toward the container 5 which is kept in position.

The attachment of the carrier sheet has so far been described as involving use of only one container.

Collective attachment of one same carrier sheet 1 to a plurality of containers can be accomplished by repeating the aforementioned procedure successively on the containers or by preparing as many sleeve members 20 and funnel members 11 as may conform with the number of containers being packaged and performing the packaging of all containers at one time. Particularly in this case, the attachment is effected more advantageously by having the sleeve members 20 fastened in advance at prescribed spaced locations onto the support surface F by means of flanges 29 disposed one each at the bases of the sleeve members 20 and screws 30 serving as securing means.

Requiring special attention in connection with the aforementioned operation is the fact that the outward expansion of the circumferential portion and consequently of the opening 2 of the sheet 1 should be effected evenly in all the radial directions throughout the entire circumference. Insofar as this requirement is satisfied, the sheet is free from otherwise possible concentration of stress and breakage of the circumferential portions. In addition, the shape of openings 2 formed in the sheet for insertion of containers need not be specifically limited. Thus, the openings can be formed in the shape of a circle which excels both in fabricability and dispersion of stress. Of course, in an extreme case, the openings 2 may be formed in the shape of a rectangle where the sheet is made of a material possessing ample elasticity.

After the sheet has been attached to the containers as described above, the containers 5 as fastened to the sheet 1 are removed from the funnel members 11. As the sleeve members 20 are gradually relieved of the pressure downwardly exerted thereto, they cause the aforementioned amply resilient force to be exerted without any hindrance upon the diverging funnel portions 14 of the funnel members 11. As a result, the force which acts upon the funnel members 11 particularly via the edges 22 of the openings in the sleeve members is transformed by virtue of the divergence of the outer surface of the diverging funnel portions 14 into a force tending to push up the funnel members 11. The funnel members 11, consequently, are caused to protrude to the position in which they were embraced without exertion of force within the sleeve members 20. In the meantime, the edges 22 of the openings in the sleeve members which have been generating the force mentioned above are allowed to resume their initial diameter.

Particularly where the funnel members 11 have their interiors left empty and they are divided in the circumferential direction by insertion of spaced slits 17, they are deprived of internal support in consequence of the removal of the containers 5 and are consequently allowed to contract inwardly by virtue of the resilient force of the sleeve members, giving rise to an effect of facilitating the resumption of their original shape.

It goes without saying that the components of the apparatus of the invention, whenever they have resumed their initial shapes, are allowed to produce the same function in the attachment of a newly supplied sheet and new containers. Optionally, the funnel members 11 may be continuously converged as far as the base ends 15.

The embodiments which are illustrated in FIG. 8 and the following figures are so arranged or to eliminate the step of preparatorily fastening the sheet to the funnel members and the step of combining the funnel members with the sleeve members. The apparatuses in these embodiments are required to incorporate additional components to make the elimination of such operational steps possible. In the following description, the components identical or similar to those used in the embodiment described above will be denoted by like symbols.

FIG. 8 represents an overall perspective view of another embodiment of this invention. This apparatus is provided with a bottom plate 31 of suitable size and weight which combines the function of stabilizing the apparatus as a whole as described afterward and the function of permitting a prescribed number of containers 5 to be mounted at the prescribed spaced locations (the illustrated embodiment assuming the attachment of six containers to the sheet designed for six containers as illustrated in FIG. 1). On the opposite lateral sides of this base plate, side plates 32 rise from part of the lateral sides in the illustrated embodiment. Near the upper end of these side plates, a bridge frame 33 is fastened to and spans the space between the side plates. This bridge frame 33 serves to support in position at least one support bar 34 which rises from the base plate 31. In the present embodiment, two such support bars were used.

Below the bridge plate 33 is disposed a movable plate 35 which is adapted to move in the vertical direction up the support bar 34 pierced through the movable plate 35. To this movable plate 35 is connected, through the medium of a hinge 36, a sleeve support plate 37 which as described afterward serves to support in position the sleeves 20 corresponding to the sleeve members of the first embodiment. While this sleeve support plate 37 is allowed to move in a vertical direction in conjunction with the movable plate 35 with reference to the support bars 34, it is permitted t produce a rotary motion with reference to the movable plate itself. The movement of the sleeve support plate 37 as viewed in the cross section taken along the line IX—IX of FIG. 8 will be described. Beneath the hinge 36 which joins the movable plate 35 having the support bars 34 pierce unconnectedly therethrough and the support plate 37 for the sleeves 20, a stop member (plate shaped in the present embodiment) 38 is disposed astride the two plates mentioned above. This stop member 38 is fastened to the movable plate 36 by use of bolts or some other suitable means. Consequently, the sleeve support plate 37 is permmitted to rotate in the direction indicated by the arrow A around a proper fulcrum, the shaft **36*a* in the present embodiment, of the aforementioned hinge 36 but is prohibited from independently rotating in the downward direction with reference to the movable plate. When a force is applied to the sleeve supprot plate in the downward direction as indicated by the arrow B, the force is conveyed to the movable plate 35 via the stop plate 38 applied fast to the lower side of the sleeve support plate, with the result that both the movable plate and the sleeve support plate are caused to move straight downardly as indicated by the chain line (the arrow C) along the support bars 34. Between the movable plate 35 and the base plate 31, there are disposed spring means 39, which accumulate a replusive force when the movable plate 35 and the sleeve support plate 37 are concurrently moved downwardly by the force applied in the direction of B. Upon release of the force B, the spring means 39 push up the movable plate 35 and the sleeve support plate 37 together. The movable plate 35 is never allowed to rise past its original position, because at the original position, there is disposed the bridge plate 33**.

In other words, the bridge plate 33 combines its inherent function of aiding in the reinforcement of the apparatus as a whole and supporting in position the support bars 34 and an additional function of fixing the initial position of the movable plate or stopping otherwise possible excessive rise of the movable plate. As readily noted, these individual functions may be optionally fulfilled by separate component elements.

As will be described afterward, one cycle of the operation of this apparatus comprises the step of preparatorily causing only the sleeve support plate 37 to be rotated in the direction of the arrow A until it is raised to its substantially vertical position as indicated by the chain line in FIG. 9, the step of causing the sleeve support plate to rotate in the reverse direction A′ to reach its original position and, under the force applied in the direction of the arrow B, to move downwardly in conjunction with the movable plate 35 in the direction of the arrow C, and the step of relieving the sleeve support plate of the applied force and allowing the plate to be pushed back in the reverse direction C′ by the spring means 39.

This operation may be effected by the operator directly applying the necessary force to the sleeve support plate 37 by hand, for example. In the illustrated embodiment, a handle 40 is connected to the sleeve support plate 37 for the purpose of alleviating the burden of manual work by the principle of leverage.

Figure 10:
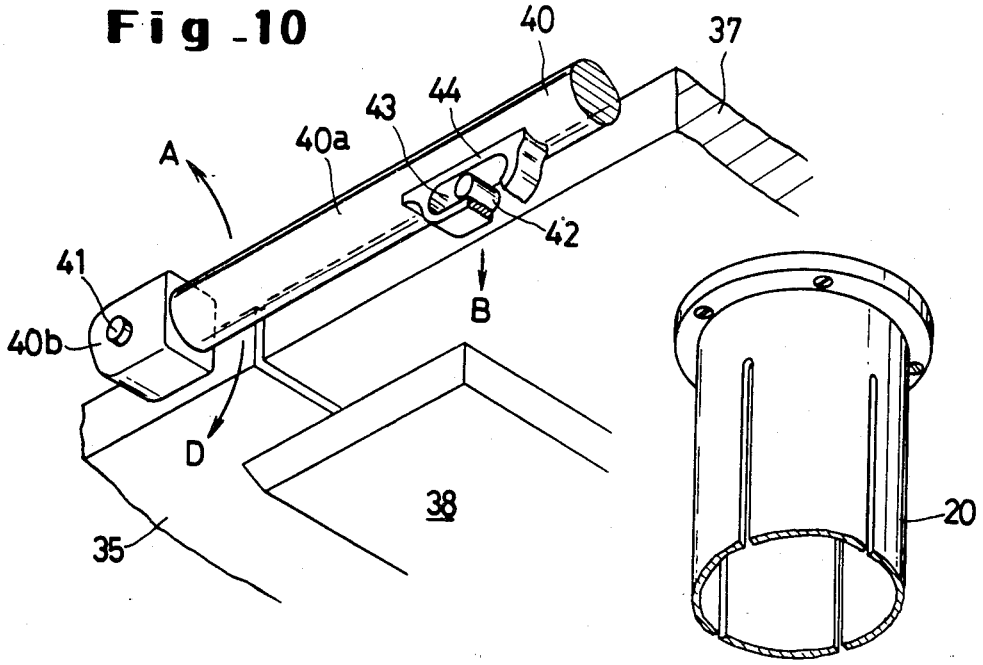
FIG. 10 is a perspective view of an essential part of the second embodiment illustrating the relation between the handle and the sleeve support plate.
Figure 11:
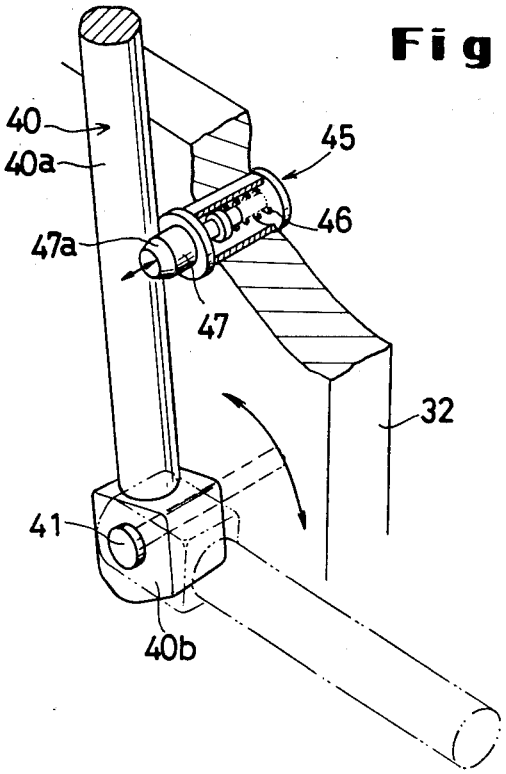
FIG. 11 is a perspective view of an essential part similarly illustrating the relation between the handle and the stopper.

The handle 40 used in this case possesses a pair of arms **40*a* laid along the opposite sides of the sleeve support plate 37. The arms 40*a* are extended, then bent at right angles toward each other and joined. Thus, the handle 40 has a general shape of three sides of a rectangle. The free ends 40*b* of the arms, as noted plainly by reference to FIGS. 10 and 11, are pivotally attached to the opposed side plates 32 through the medium of fulcrum shafts 41 such as aligned pins. Thus, the free ends are allowed to rotate about the aforementioned fulcrum shafts 41** not only in the direction indicated by the arrows A—A′ but also in the downward direction indicated by the arrows D—D′.

This handle 40 is operated by the operator using, as the grip portion **40*c*, the portion where the extended parts of the arms join into each other. In the case of the mechanism illustrated, the fulcrum shafts 41 are fastened at positions slightly deviating from the positions of the support shafts of the sleeve support plate 37. If the handle is otherwise disposed so that the slight positional deviation is eliminated, while the handle is allowed to rotate upwardly, it is not allowed to produce a straight downward motion because it is primarily designed to rotate around the fulcrum shafts 41. By this reason, this handle cannot be directly fastened to the sleeve support plate under any condition. In the present embodiment, therefore, pins 42 are raised one each from the opposite sides of the sleeve support plate 37 and complementary engaging members 44 each defining an oblong hole 43 therein are formed at the corresponding portions of the arms 40*a* of the handle 40 to have the pins 42 engaged inside the oblong holes 43 as illustrated in FIG. 10. Thus, linkages are established between the support points 36*a* and the fulcrum points 41 as viewed from the position of the engagement and between the fulcrum points 41 and the support bars 34. By virtue of this arrangement, when the handle 40 is rotated in the direction indicated by the arrow A, the sleeve support plate 37 is concurrently rotated upwardly about the support shafts 36*a* because the movable plate 35 is prevented from being raised upwardly by the bridge plate 33, with the result that the sleeves 20 are exposed to the operator who is holding the handle in his hand. When the handle is returned to its horizontal position and then further rotated downwardly (in the direction of the arrow D), the sleeve support plate 37 is allowed to be lowered straight downwardly in the direction of the arrow C in conjunction with the movable plate 35**.

It should be noted at this point that after the sleeve support plate 37 has been rotated up to its uppermost position, it must be maintained at that position at least for a period during which the sheet is inserted thoroughly around the funnel members 11 within the sleeves 20 as will be described afterward. It is a good practice for the safety of work that the operator should take some positive measure to keep the sleeve support plate 37 or the handle 40 from accidentally falling down because of slight vibrations or other impacts during the work of the insertion of the sheet.

Figure 9:
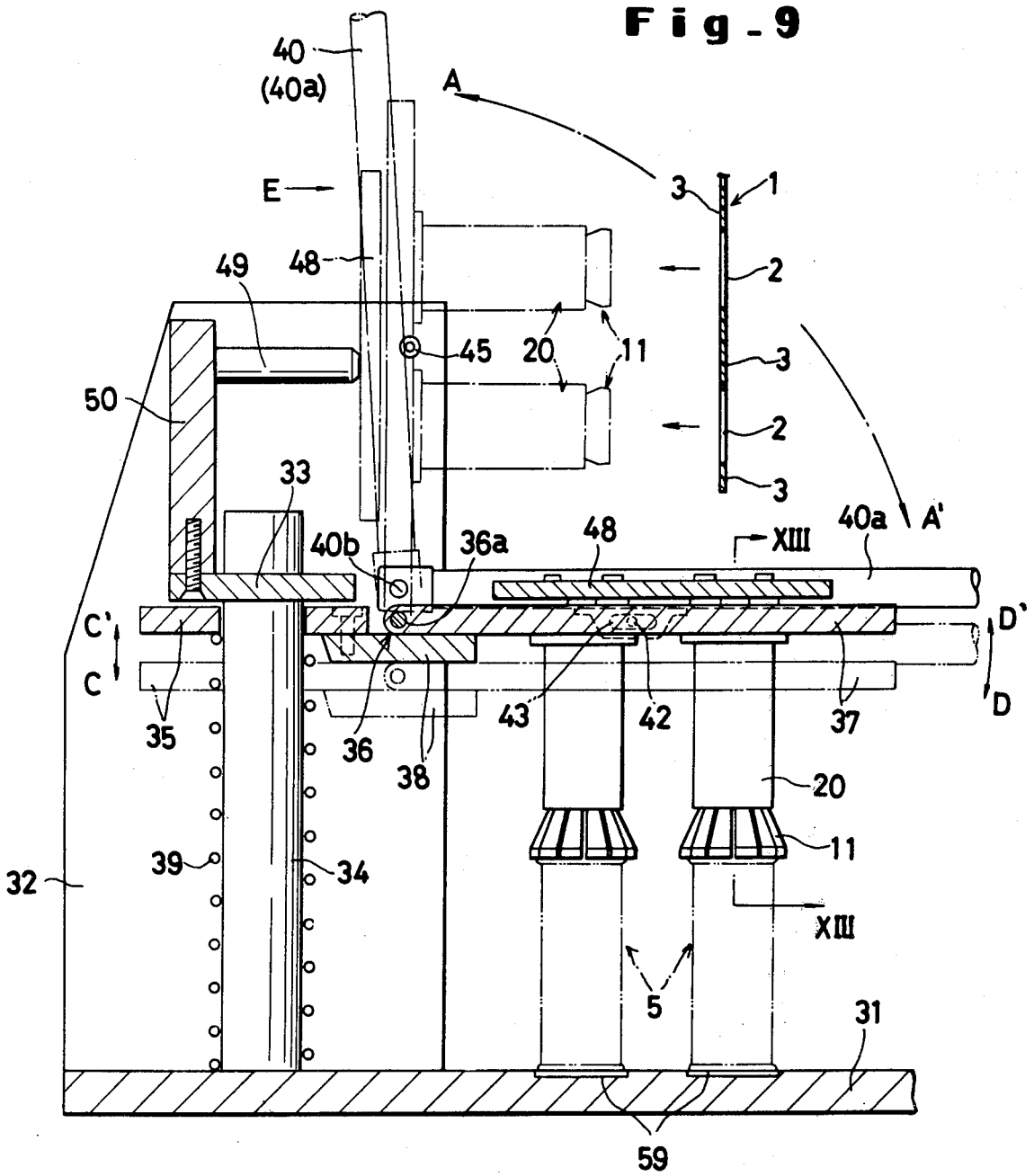
FIG. 9 is a sectioned view of the second embodiment taken along the line IX—IX of FIG. 8.

In due consideration of the operational safety mentioned above, the present embodiment has the opposite side plates 32 provided at the corresponding positions with stoppers 45 which are adapted to get gentle hold of the arms 40*a* while the handle 40 is retained in the position to which the handle has been rotated in the first step of operation (as indicated by the chain line in FIG. 9).

One example of such stopper is clearly illustrated in FIG. 11. Small pins 47 which are always kept protruding as by means of springs 46 concealed within the side plates are provided immediately in front of the position at which the handle arms 40*a* being rotated in the first step of the operation reach their uppermost position (a position slightly inclined to the rear in the illustrated embodiment) in the whole course of their rotation. After the handle arms 40 have collided with these small pins 47, the operator at his discretion continues the rotation of the handle 40 with a slightly increased force. Then, by virtue of the converging outer surfaces 47*a* of the pins, the force of this rotation of the handle overcomes the force exerted on the small pins by the springs and causes the small pins to retract from the paths of rotation of the handle.

After the handle which is being rotated upwardly has reached the point where the handle arms 40*a* collide with the small pins 47, the operator continues to rotate the handle in the same direction by slightly increasing the force being exerted upon the handle. Consequently, the small pins 47 are retracted from the path of the rotation of the arms. After the handle has completely traveled past the small pins, the small pins are allowed to resume their original protruding portions by virtue of the spring means 46. When the operator lets go of the handle after the handle has assumed the position mentioned above, the handle is naturally kept back by the stopper pins 47 unless it is subjected to some unexpectedly applied external force. Consequently, the sleeve support plate 37 is maintained in a position having the sleeves 20 exposed toward the operator.

For the handle held in this position to be returned past the small pins 47 to its original position, the operator is naturally required to increase the force applied to the handle only while the handle arms are riding over the small pins 47.

Another relative motion which is involved in the present embodiment is observed on the sleeve support plate 37 between this sleeve support plate 37 itself and a collective actuating plate 48 which serves as a member for actuating the funnel member contracting means (to be described afterward) disposed at a position opposite the position where the sleeves 20 are located below the sleeve support plate 37. Here, only the relative motion involved will be described. While the sleeve support plate 37 remains in its original horizontal position in conjunction with the movable plate 35, the actuating plate 48 is retained in a position slightly raised from the sleeve support plate by resilient means described afterward. At the time that the sleeve support plate 37 is brought to its erect position by the operation of the handle and the sheet is attached to the funnel member, the actuating plate 48 is pressed against the sleeve support plate 37 (as indicated by the arrow E in the diagram). Optionally, this operation of the actuating plate may be effected manually by the operator. In the case of the illustrated embodiment, however, a relative pressure pin 49 adapted to be pushed back toward the sleeve support plate 37 by the actuating plate at the time that the sleeve support plate 37 is held in its erect position is disposed on the bridge plate 33 through the medium of a column 50 (FIGS. 8 and 9).

Now that the overall movements of the component elements has been explained, the description will be extended to cover the arrangement whereby the operation for the attachment of the sheet 1 to the containers 5, that for the attachment of the sleeves 20 and the funnel 11 involved in this case, and that for the preparatory attachment of the sheet 1 to the funnel members 11 additionally incorporated in the present embodiment as effected from the side of the leading end of the funnel members (as contrasted to the side of the base ends in the first embodiment) are to be performed.

This embodiment contemplates simultaneous attachment of one sheet 1 to a total of six containers 5. For the sake of convenience, the operation and construction of the embodiment will be described with respect to the attachment of the sheet 1 to just one of such containers with reference to FIG. 12 and the following figures of drawing.

The funnel member 11, similarly to the funnel member used in the first embodiment, has a leading end which has a diameter greater than the opening 2 formed in the sheet 1 for insertion of a container, and possesses a contact portion 15 incorporating a wall surface 19 having a diameter substantially equal to the diameter of the peripheral edge 7 of the container and enough to encircle the peripheral edge. In contrast to the first embodiment wherein the funnel member is not necessarily required to be flexible in the radial direction and is consequently allowed to be solid, the funnel member of the present embodiment requires due consideration to be paid to the fact that the sheet 1 is inserted around the funnel member from its leading end upwardly and, therefore, there is incorporated a new step of contracting the leading end of the funnel member during the insertion of the sheet 1. After the insertion of the sheet 1 has been completed, the leading end so contracted is naturally required to be expanded to its original diameter by virtue of resilience. To meet the requirement, the funnel member 11 is divided in the circumferential direction such as by spaced slits 17 and has its interior left empty. To avoid complication of the drawing, these slits 17 are represented only partially by chain lines in FIG. 13 and the following figures.

Similarly to the funnel member used in the first embodiment, the funnel member 11 of the present embodiment possesses a funnel portion 14 whose outer surface is gradually converged toward the end portion or base end 15 opposite the leading end. At one point halfway along the entire length, the funnel member 11 has a diameter substantially equal to the diameter of the opening 2 formed in the sheet 1.

In this case, unlike the larger-diameter portion 14*a* which continues to diverge toward its leading end 13, the equal-diameter portion 14*b* continues to have the same diameter in the direction of the base end and eventually decreases the diameter toward the second diverging portion 14*c*.

The funnel member of the construction described above is adapted so that, as illustrated in FIGS. 13–16, after the base end 15 has passed through the prescribed position in the sleeve support plate 37, a limiting ring 52 set at the corresponding position in the base end of the funnel member is allowed to collide with a circumferentially stepped portion 51 disposed astride the outlet of the through hole perforated in the sleeve support plate so that the funnel member is allowed to slide only in one direction relative to their initial position illustrated in FIG. 13 (the initial state of FIGS. 8-9 existing before the handle or the sleeve support plate is actuated).

For the funnel member 11 of such construction to assume the same relation as established in consequence of the initial insertion of the funnel members into the sleeve in the first embodiment, the individual sleeves 20 are fastened by means of flanges 29 and screws 30 to the sleeve support plate in such a manner as to accommodate the funnel member and enable the edge 22 of the opening at the leading end to collide with the base of the diverging outer surface 14*a*. The construction of the sleeve may be similar to that of the sleeve used in the first embodiment.

In other words, the funnel member 11 with reference to the sleeve is allowed to move inwardly in the axial direction from the position in which the equal-diameter portion 14*b* or the base of the larger-diameter portion having a diameter substantially equal to the diameter of the opening 2 of the sheet 1 is held in intimate contact with the edge 22 of the opening. To prevent the funnel member from protruding further, the aforementioned limiting ring 52 is adapted to come into engagement with the sleeve support plate 37.

Between the radial direction of the sleeve 20 and that of the funnel member 11, a contracting member 54 having its leading end 54 opposed to the second diverging portion 14*c* is inserted in the axial direction. The contracting member 54 slidably penetrates through the sleeve support plate 37, with the base end thereof fastened to the actuating plate 48 disposed on the sleeve support plate 37. As viewed collectively in conjunction with the funnel member and the sleeve, the contracting member 54 appears to be in a cylindrical shape. If it was of a construction closed completely throughout the entire circumferential direction, it would separate the inner central portion 37*a* of the sleeve support plate from the respective outer portion 37*b*. Thus, it is generally divided into four equal portions at angular intervals of about 90° so as to permit passage through the intervening gaps of the portions which connect the inner and outer portions of the sleeve support plate.

In order that the actuating plate 48 supporting the concentrically disposed contracting members 54, its initial condition may remain in a position slightly raised by a prescribed distance from the sleeve support plate 37, spring means 56 is disposed between the actuating plate 48 and the sleeve plate 37. In this case, the spring means 56 has one end thereof disposed inside a recess formed to a small depth from the surface of the base end of the funnel member. It exerts a relative force to the sleeve support plate through the medium of the aforementioned controlling ring 52 and the stepped portion 51.

Further in the present embodiment, there is adopted a guide member 57 of high rigidity to aid in stabilizing the operation to be described below. This guide member 57 is passed through the inner space 18 of the funnel member, pierced slidably through the base end 15 and screwed into the actuating plate 48. The leading end of the guide member 57 constitutes a swelled portion 58 which internally engages with the funnel member in the neighborhood of its leading end.

This swelled portion 58 comprises an outwardly converging portion 58*a*, a stepped portion 58*b* continuing into the converting portion 58*a* and remaining in contact with the stepped portion 14*d* formed in the inner surface of the large-diameter portion 14*a* of the funnel member, and an inwardly converging portion 58*c* continuing into the stepped portion 58*b* in such a manner as to retain the upper surface of the stepped portin 58*b* intact. In its initial state illustrated in FIG. 13, the stepped portion 58*b* engages with the corresponding stepped portion of the funnel member 11 and retains the diverging funnel portion 14 of the funnel member in contact with the edge 22 of the opening in the sleeve. At the same time, a stop ring 59 is kept in contact with the entrance to the through hole formed in the funnel member's base end so that the funnel member may not be allowed to deviate from the aforementioned position inwardly in the axial direction (upward in the drawing). The energizing force exerted by the spring means 56, therefore, is distributed to the actuating plate 48 fastened to one end thereof and to the other end via the stop ring 59 of the guide member 57 fastened to the actuating plate. Thus, the spring means fulfills an auxiliary function of allowing the actuating plate 48 to be kept in its prescribed raised position.

Figure 13:
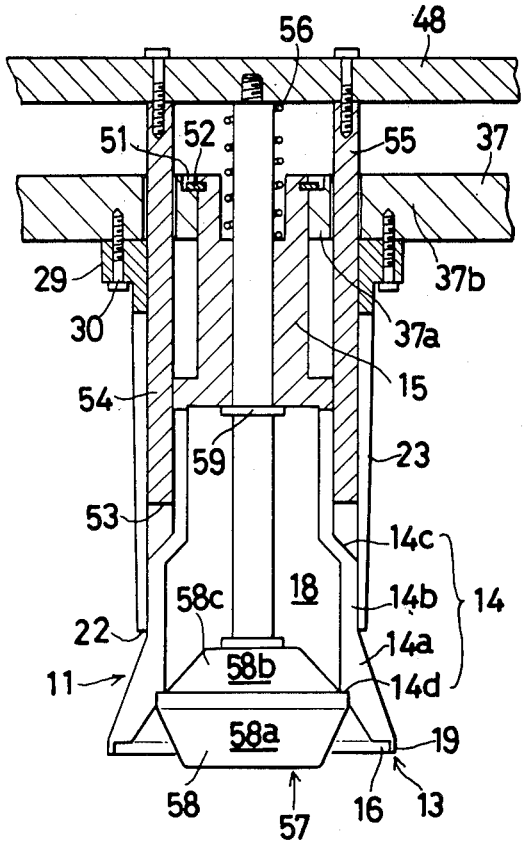
FIGS. 13–16 are sectioned views of an essential part of the second embodiment illustrating the operation.
Figure 14:
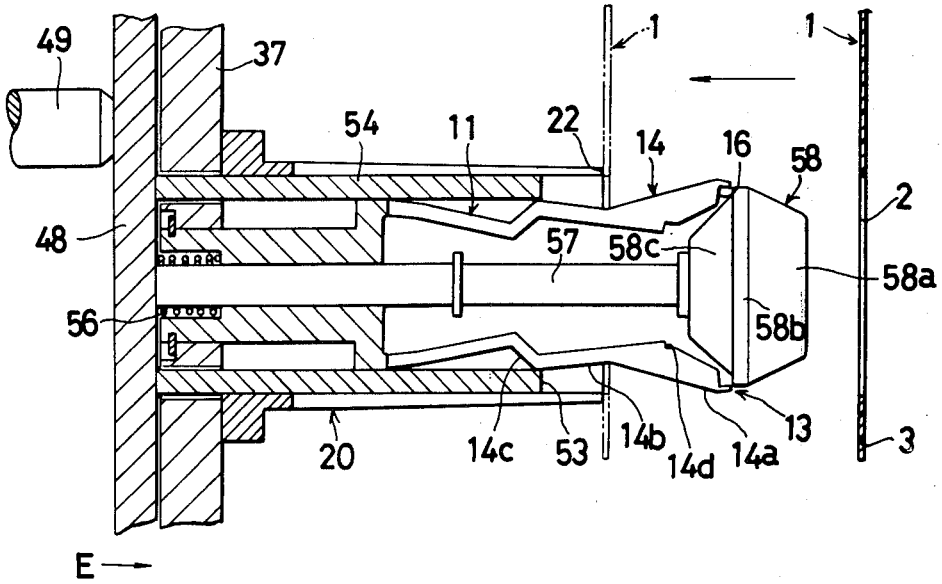

The arrangement described above is provided for each of the plurality of containers (say, six) and all the arrangements are disposed so as to be interlocked with the sleeve support plate 37 and the actuating plate 48. The operation of the apparatus is now followed step by step, starting from FIG. 13 and referring to FIGS. 8 and 9. When the sleeve support plate 37 as held in the state shown in FIG. 13 is upwardly rotated in the direction of the arrow A by the aforementioned operation, of the handle 40, the actuating plate 48 carrying the contracting member 54 thereon is caused to rotate in conjunction with the sleeve support plate as held in its position slightly raised from the support plate 37. When the actuating plate eventually collids with the relative pressure pin 49, it is pushed by the pressure pin and moved in the direction of the arrow E in spite of the energizing force exerted by the spring means 56 and, therefore, allowed to travel in the direction of colliding with the sleeve support plate 37 (FIG. 14). As a result, the guide member 58 protrudes relative to the funnel member 11 and causes the stepped portion 58*b* to move forward until it is opposed in the radial direction with ample space allowance to the stepped portion 14*d* inside the funnel member which has so far kept the inwardly converging portion 58*c* in contact therewith. At the same time, the contracting member 54 is allowed to produce a relative forward motion, and the leading end 53 thereof is caused to ride over the second diverging portion 14*c* of the funnel member and, by virtue of the pressure exerted reversely in the inward direction, the funnel member is contracted until the leading end 13 thereof shrinks to a size roughly equal to or smaller than the diameter of the edge of the opening in the sleeve. As a result, the sheet 1 to be attached to the container can be easily inserted through its own opening 2 around the funnel member from the leading end 13 upwardly (as indicated by the chain line in FIG. 14).

This operation is accomplished by bringing the prescribed number of openings 2 all at once into intimate contact with the plurality of funnel members disposed at prescribed intervals.

During this operation, the handle 40 is temporarily fastened by means of the aforementioned stopper 45 (FIG. 11) so that the sleeve support plate 37 is retained in its erect position in front of the operator until the work of contracting the funnel members is brought to completion (by having the actuating plate 48 held in a position pressed by the pin 49).

After the attachment of the sheet 1 is completed as described above, the handle 40 is rotated back in the direction of the arrow A' and caused to ride over the stopper 45. Consequently, the actuating plate 48 is relieved of the pressure from the pin 49 and returned by the energizing force of the spring means 56 to resume its original position slightly raised by the prescribed distance from the sleeve support plate 37.

Also the contracting member 54 is drawn back to its original position and the leading end 53 thereof releases itself from the pressed engagement with the second diverging portion 14*c* and allows the diverging funnel portion 14 of the funnel member to resume its original shape. At the same time, the guide member 58 substantially resumes its original shape and causes the diverging funnel portion 14 to support inwardly the relation between the stepped portion 58*b* and the stepped portion 14*d*.

Although the direction in which the insertion of the sheet 1 around the funnel member is different from that involved in the first embodiment, the circumferential portions 3 surrounding the openings in the sheet are opposed to the edges 22 of the openings in the sleeves and are then set around the portions of the funnel members where their respective diameters are substantially equal to each other.

While producing the steps of operation described above, the handle 40 is returned to its horizontal position. At least before the handle 40 assumes its horizontal position or, desirably while the aforementioned setting of the sheet is still in process, the prescribed number of containers 5 to which the sheet is to be attached are set in position on the base plate 31 at positions opposed to the corresponding funnel members and sleeves. To facilitate this positioning of the containers on the base plate, it is generally desirable to have recesses 59 formed at the prescribed positions in the base plate 31 for receiving the ends of the containers opposite their ends intended for attachment of the sheet 1.

As the sleeve support plate 37 is brought back to its horizontal position, the contact portion 16 formed on the leading end 13 of the funnel member for the purpose of contact with the container 5 comes into contact with the peripheral edge 7 of the container. The leading end portion 58*a* of the guide member is desired to have a length such that, when the contact portion 16 comes into contact with the peripheral edge 7, the leading end portion will protrude in the axial direction so much as to collide with the surface 8 of the container.

When the handle 40 is further rotated downwardly in the direction of the arrow, D, since the sleeve support plate 37 is prevented by the stop member 38 from producing a downward rotation as described above, it is lowered straight in the downward direction in conjunction with the movable plate 35 (in the direction of the arrow B). As a result, the actuating plate 40 disposed on the sleeve support plate is now allowed to go down because the funnel member 11 and the guide member 56 are held in engagement with the end of the container 5. Thus, only the sleeve 20 is allowed to go down while the leading end 22 is slid on the larger-diameter portion 14*a* of the funnel member in the direction of divergence. As indicated by the chain line in FIG. 15, the circumferential portion 3 surrounding the opening 2 in the sheet is pushed down in the axial direction similarly to the first embodiment (while entailing a twist R, for example) along the diverging surface of the larger-diameter portion 14 of the funnel member 14, with the circumferential portion 3 being simultaneously expanded outwardly in the direction of the arrow W.

Figure 16:
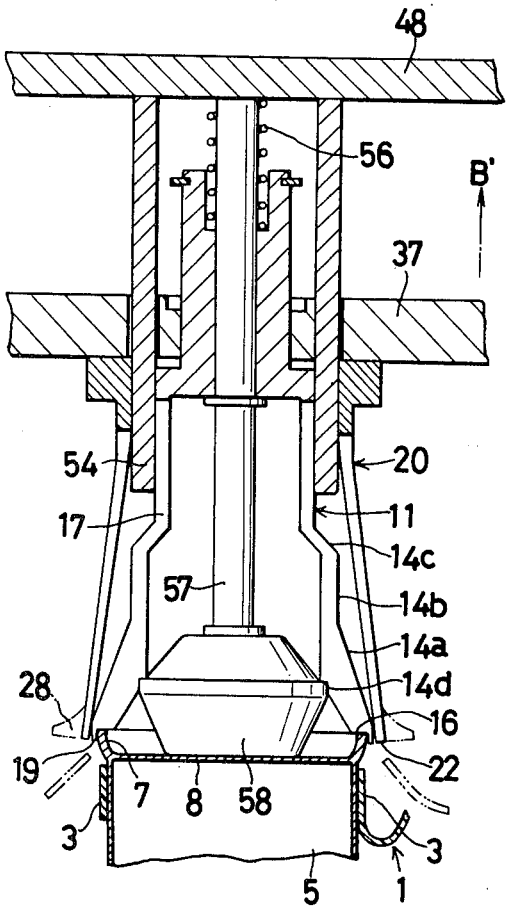

When the leading end 22 of the sleeve 20 reaches the leading end of the diverging funnel portion 14, the outwardly deformed sheet 1 resumes its original shape underneath the peripheral edge 7 of the container 5 and clings to the container similarly to the first embodiment. Since the same operation is simultaneously performed on the other containers, the simultaneous attachment of the sheet 1 to the group of containers 5 can be accomplished (FIG. 16). In order for the sheet 1 to be pushed forward and expanded uniformly throughout the entire circumference thereof, the edge 22 of the opening in the sleeve may be provided with a protuberance 28 as specifically noted with reference to the first embodiment.

After the attachment of the sheet has been completed as described above, the handle 40 is returned to its original position. In this case, the force required to being the handle to its original position may be decreased or completely eliminted when the resilient force exerted by the spring 39 upon the movable plate and the aforementioned resilient force generated by the sleeve 20 are utilized to produce a force capable of lifting the sleeve support plate 37 to its original position separated by the prescribed distance from the actuating plate 48. (In this case, the handle jumps up when the pressure applied to the handle is removed.) Similarly to the first embodiment, a rubber band or some other similar elastic material may be wound around the sleeve so as to enhance the resilient force of the sleeve.

From the state illustrated in FIG. 16, the apparatus moves in the direction of the arrow B' and returns to its original state illustrated in FIG. 13. Thereafter, the upward rotation of the handle is started to begin the next cycle of the attachment of the sheet to the containers. The replacement of the containers already bound with the sheet by a newly supplied set of containers is accomplished ideally during the step of inserting the sheet around the contracted funnel members with the handle retained in its uppermost position by the stopper 45.

Incidentally in the present embodiment, the diverging funnel portion 14 of the funnel member 11 possesses first and second portions 14*a*, 14*c* of diverging surfaces in two separate steps. Optionally these diverging portions may be continued into each other without any intervening flat (equal-diameter) portion 14*b*.

In view of the foregoing operation of the present embodiment, it may readily be understood that the sleeve support plate 37 serving to support in position the sleeve 20 in the second embodiment fulfills the function of the support surface F touched upon in the first embodiment.

Figure 15:
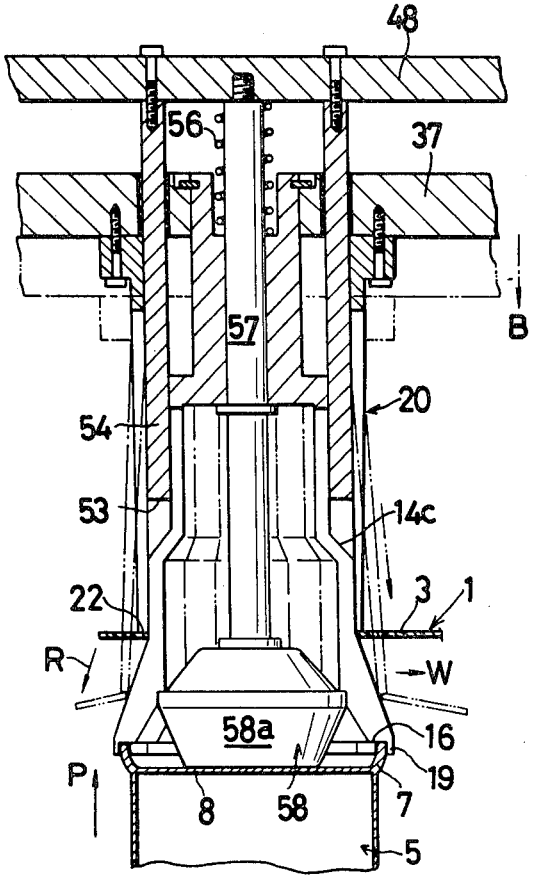

This function can otherwise be fulfilled by causing the base plate 31 of the apparatus to be pushed up in conjunction with the container in the aforementioned direction of the arrow P after the sheet has been temporarily set in position as illustrated in FIG. 15 and allowing the actuating plate 48 to be pushed up in conjunction with the funnel member 11 and the guide member 57. Also the simultaneous upward movement of the sleeve support plate and the actuating plate for the purpose of temporary attachment of the sheet to the funnel members can be accomplished by having the plates translated in the vertical direction instead of causing them to be rotated. In the case, however, the efficiency of operation is degraded to some extent.

In any event, according to the present invention, there is provided an effective apparatus for the attachment of a carrier sheet to containers, which, owing to the basic combination of the funnel members and the sleeves, permits the carrier sheet to be readily attached below the peripheral edges of the containers while enabling the sheet to be expanded uniformly in all the radial directions without entailing the possibility of the sheet sustaining breakage. Although the embodiments of this invention have all been described with respect to their operation upon just one container, simultaneous attachment of one same carrier sheet to a large number of containers can be accomplished all at once by causing as many apparatuses of the same construction to be parallelly arranged as required to handle a plurality, desirably a large number, of containers (specifically in the second embodiment, by having the same sleeve support plate and the actuating plate disposed commonly for such plurality olf apparatuses). The sheet thus attached to the containers may be cut into smaller carrier sheets each holding a proportionally smaller number of containers, conveniently for the purpose of carrying.

What is claimed is:

1. An apparatus for the attachment of a carrier sheet to containers wherein the carrier sheet containing openings of a diameter smaller than the diameter at the peripheral edges of the containers and permitting insertion therethrough of the containers is attached below the peripheral edges of the containers by causing the circumferential portions surrounding the openings in the carrier sheet to be forcibly expanded outwardly to be passed over the peripheral edges, which apparatus comprises: vertical funnel members for carrying said carrier sheet each having an upper portion of a diameter smaller than the diameter of the openings in the carrier sheet and a funnel-shaped portion having an intermediate portion of a diameter substantially equal to the diameter of the openings and a lower large diameter leading end portion engageable with the peripheral edge of the container positioned below the funnel, each of the funnel members containing slits cut in the axial direction upwardly from the lower end of the large diameter portion thereof to permit the large diameter portion to be contracted in the radial directions; sleeve members each having an upper end and a lower edge and containing an inner space large enough to embrace therein the funnel member wholly and slits cut in the axial direction in the wall defining the inner space upwardly from said edge thereof to divide the wall and enable said edge of the opening to be expanded in the radial directions over said funnel leading end portion thereby pushing said carrier sheet over the containers, the edge of the opening in a normal condition having a diameter smaller than the largest diameter of the large diameter portion of the funnel member and contracting members each disposed concenrtrically between the funnel member and the sleeve member, slidably mounted relative to both the aforementioned members, so that the leading end thereof is moved into contact with the funnel-shaped portion of the funnel member and, through the medium of the funnel-shaped portion, contract the leading end of the funnel member to a diameter smaller than the diameter of the opening in the carrier sheet to permit mounting of said carrier sheet on the funnel; a bottom plate member which stabilizes the apparatus and supports the containers to be packaged, said sleeve members being fastened at their upper ends to a sleeve support member positioned above the bottom plate member, the funnel members pass through said sleeve support member at an end portion opposite said leading end thereof and penetrate the sleeve members to the portions thereof having a diameter substantially equal to the diameter of the openings in the carrier sheet, the funnel members and the sleeve members are interposed to stop means each adapted to enable the funnel member to be slid in the axial direction only upwardly from the position which the funnel member has reached in the penetration of the sleeve member, the contracting members pass through the sleeve support member and are fastened to an actuating member disposed at a prescribed distance from the sleeve support member, and the actuating member is supported in a manner slideable in the direction of the sleeve support member; the actuating member to which the contracting members are fastened being separated by the prescribed distance from the sleeve support means through the medium of intervening spring means; a member for holding the sleeve support member at a height such that the sleeves supported by the sleeve support member face downwardly toward the bottom plate member and the leading ends of the funnel members engage with the peripheral edges of containers, hinge means allowing the sleeve support member to rotate upwardly away from the bottom plate member and relative to the holding member, a stop member to prevent the sleeve support member from rotating in the downward direction, energizing means for supporting the holding member at its original position corresponding to the aforementioned height at which the sleeve support member is supported and, after the holding member has been vertically lowered, relative to the bottom plate member, from the original position in conjunction with the sleeve support member, imparting to the holding member an energizing force capable of returning the holding member to the original position, means actuated, upon an upward rotation of the sleeve support member, to come into engagement with the actuating member having the contracting member fastened thereto and press the actuating member against the sleeve support member.

2. The apparatus according to claim 1, which further comprises handle means rotatable around one point as the fulcrum and connected through linkage means to the sleeve support member so as to enable the sleeve support member to rotate in the upward direction relative to the bottom plate member and the holding member to move straight in the downward direction relative to the bottom plate member in conjunction with the sleeve support member.

* * * * *